US008177548B2

(12) United States Patent
Kretschmer et al.

(10) Patent No.: US 8,177,548 B2
(45) Date of Patent: May 15, 2012

(54) DEVICE FOR MOUNTING A FAN BURNER ON A COMBUSTION CHAMBER

(75) Inventors: Sebastian Kretschmer, Dresden (DE); Enrico Seemann, Freital/OT Weißig (DE); Torsten Lohse, Freital (DE); Klaus Beckmann, Chemnitz (DE); Hendrik Kretzschmar, Chemnitz (DE)

(73) Assignee: Elco Burners GmbH, Pirna (DE)

( * ) Notice: Subject to any disclaimer, the term of this patent is extended or adjusted under 35 U.S.C. 154(b) by 1092 days.

(21) Appl. No.: 11/316,167

(22) Filed: Dec. 22, 2005

(65) Prior Publication Data

US 2006/0160042 A1 Jul. 20, 2006

(30) Foreign Application Priority Data

Dec. 23, 2004 (DE) ..... 10 2004 062 185

(51) Int. Cl.
*F23D 11/00* (2006.01)

(52) U.S. Cl. ..... 431/343; 431/154; 431/159; 431/189; 431/264; 431/277; 248/363; 248/637; 248/75; 373/66; 373/128; 192/70; 192/84.1; 126/67; 126/70

(58) Field of Classification Search ..... 431/343, 431/154, 159, 186, 189, 121, 265, 264, 203, 431/277, 283; 239/140, 587.1, 273; 373/66, 373/24, 128; 219/536; 192/70.11, 84.1; 165/122; 248/636, 637, 75; 126/70, 71, 126/72, 109

See application file for complete search history.

(56) References Cited

U.S. PATENT DOCUMENTS

| | | | | |
|---|---|---|---|---|
| 2,126,109 | A * | 8/1938 | Hanson | 126/1 F |
| 2,773,460 | A * | 12/1956 | Svendsen | 431/186 |
| 3,304,982 | A * | 2/1967 | Fisher | 431/182 |
| 3,667,893 | A | 6/1972 | Zenkner | |
| 3,869,243 | A * | 3/1975 | Creuz | 431/90 |
| 3,982,496 | A * | 9/1976 | Blanchard | 440/52 |
| 4,477,248 | A * | 10/1984 | Dulac | 431/153 |
| 4,623,313 | A * | 11/1986 | Ferguson | 440/77 |
| 5,666,944 | A * | 9/1997 | Ferguson | 122/18.3 |
| 2004/0075029 | A1 * | 4/2004 | Clausen et al. | 248/117.1 |
| 2006/0035189 | A1 | 2/2006 | Berstecher et al. | |

FOREIGN PATENT DOCUMENTS

| | | |
|---|---|---|
| DE | 1 955 037 U | 2/1967 |
| DE | 1955037 | 2/1967 |
| DE | 68 13 031 U | 1/1972 |
| DE | 6813031 | 1/1972 |

(Continued)

OTHER PUBLICATIONS

Multiflam brochure of Company Weishaupt, dated Jan. 1999, "Fuel Proportioning—Now in Oil Burners With Near Blue Flame", pp. 1-12 with English translation summary.

Technical data sheet of company Viessmann, dated Jul. 1999, pp. 1-9 with English translation summary.

Weishaupt Zweistoffbrenner WGL 30 brochure of Company Weishaupt, pp. 1-8 with English translation summary, Jan. 1999.

(Continued)

*Primary Examiner* — Steven B McAllister
*Assistant Examiner* — Avinash Savani
(74) *Attorney, Agent, or Firm* — Harness, Dickey & Pierce, P.L.C.

(57) ABSTRACT

Device for mounting a forced-air burner 2 to a combustion chamber housing 4, having an attaching section to attach the device to a combustion chamber housing 4 demarcating a combustion chamber or to a unit 5 located on a combustion chamber housing 4 and a seating section to absorb forces and/or moments caused by a forced-air burner 2 located on the device.

11 Claims, 5 Drawing Sheets

FOREIGN PATENT DOCUMENTS

| | | | |
|---|---|---|---|
| DE | 39 25 264 | C1 | 10/1990 |
| DE | 3925264 | | 10/1990 |
| DE | 9300528 | | 4/1993 |
| DE | 9416641 | | 2/1995 |
| DE | 4436527 | | 4/1996 |
| DE | 20 2004 001 084 | U1 | 6/2004 |
| EP | 0 609 972 | A1 | 1/1994 |
| EP | 0609972 | | 8/1994 |

OTHER PUBLICATIONS

Weishaupt Gasbrenner Typ G brochure of Company Weishaupt, Jun. 2004, pp. 1-24 with English translation summary.

Commissioning and Maintainance Instruction of company Buderus Heiztechnik, dated Mar. 2001, pp. 1-54 with English translation summary.

Technical drawing of company Viessmann, dated Feb. 29, 1999, p. 1.

* cited by examiner

DEVICE FOR MOUNTING A FAN BURNER ON A COMBUSTION CHAMBER

FIELD OF THE INVENTION

The present invention relates generally to devices for forced-air burners and in particular to a device with which a forced-air burner can be attached directly or indirectly to a combustion chamber housing which demarcates a combustion chamber.

BACKGROUND OF THE INVENTION

Known forced-air burners for liquid or/and gaseous fuels (e.g. in accordance with DIN EN 267/676 or DIN EN 746), in particular what are called monobloc burners, are normally attached suspended to a combustion chamber (e.g. boiler) or a combustion chamber housing demarcating said chamber. It is customary to locate the forced-air burner on the combustion chamber housing or by way of a module interposed therebetween which is used to introduce fuels.

Forces arising In the attached position, in particular weight, and forces arising when the forced-air burner is operating, are transferred through the housing for the forced-air burner into the combustion chamber housing. The same applies to moments arising in the attached state and during operation.

Accordingly, the housing for the forced-air burner must be designed as a whole with respect to its mechanical durability to absorb forces and moments from the forced-air burner; it is not sufficient just to consider the burner housing in isolation. The module must also be designed accordingly when using a module located between the forced-air burner and the combustion chamber housing.

When designing the burner housing, or the module, special attention must be paid to the blower motor, the fan impeller, the induction plenum with the throttle valve, electronic components, hydraulic components and mechanical combination regulator in particular because of their mass.

If the housing is thought of as an air ducting device, the dead weight of the housing increases with increasing air capacity. With increasing air capacity, which can be considered as correlated to firing capacity, the mass of the components enclosed by and attached to the housing increases further. Specific components in particular, such as for example, the blower motor and the fan impeller, contribute in particular to the increase in mass of the forced-air burner as a whole. The consequence is that the ratio of the component mass of a forced-air burner without its housing to the mass of the burner housing becomes greater, the higher the air capacity, or the firing capacity.

In order to take account of the increased forces and moments arising in the forced-air burner with increasing air capacity, or firing capacity, the design complexity with respect to the housing has to be increased accordingly. Sometimes complex calculations are required, for example, to determine mechanical stresses in the housing. The materials used for the housing have to be dimensioned accordingly, for example, provided with suitable wall thicknesses to meet the increased requirements for mechanical durability.

A further disadvantage of known burner layouts is that to obtain access to a module located between the burner and the combustion chamber housing or mixing device it is necessary to swing the burner away completely from the module, or the burner together with the module away from the combustion chamber housing. To do this, hinges are employed which are attached to the burner and the module, or to the module and the combustion chamber housing. These hinges have to sustain the forces and moments generated during the swinging motion, caused in particular by the heavy burner housing. There is no possibility of designing the combustion chamber housing to allow access to the module, or the mixing device, because of the above requirement for the combustion chamber housing regarding the absorption of forces and moments.

One well-known approach to solving this problem consists of diverting the forces and moments generated by the forced-air burner vertically downward into the ground. A trestle is normally used for this, which is mounted on the floor and attached to the frame of the forced-air burner. Specifically, it is customary to attach the blower motor of the forced-air burner to the frame, while the additional components of the forced-air burner are located on the motor. What this achieves is that the design for the housing only needs to take the mass of the housing into consideration with respect to mechanical durability. This approach, which is known from the field of fans, has the disadvantage that a plurality of trestles of different heights has to be provided for different installation heights, for example, depending on the type of boiler. Furthermore, it is necessary when using this procedure to ensure that the trestle, or the forced-air burner mounted on it, is decoupled from the vibrations of the combustion chamber or the combustion chamber housing. Otherwise because of the vibration loop from forced-air burner to combustion chamber housing to floor to forced-air burner, damage may result to the trestle, the forced-air burner and the combustion chamber housing and to other components involved in the vibration loop.

OBJECT OF THE INVENTION

The object of the present invention is to provide a solution for the problems with forced-air burners identified above.

In particular the object of the present invention is to prepare a solution for the construction of weight-optimized and easy-to-handle burner housings.

SUMMARY OF THE INVENTION

The object named above is achieved by the present invention with a device for mounting a forced-air burner to a combustion chamber housing in accordance with the features of claim 1. Additional aspects and embodiments of the inventions can be derived from the dependent claims, the description which follows and the drawing.

The present invention prepares a device in particular for a forced-air burner which comprises an attaching section to attach the device to a combustion chamber housing demarcating a combustion chamber or to a unit located on a combustion chamber housing and a seating section to absorb forces and/or moments caused by a forced-air burner located on the device.

Preferably the attaching section comprises a flange to achieve an interference fit and/or positive-locking connection to a combustion chamber housing or to a unit located on a combustion chamber housing.

The attaching section can preferably be an area to locate a burner tube of a forced air burner.

The area for locating a burner tube of a forced-air burner can preferably be an opening formed in the attaching section through which a burner tube can be passed, or a seat formed in the attaching section into which a burner tube can be inserted.

The area for locating a burner tube for a forced-air burner can preferably be configured to provide positive-locking location of the burner tube.

The flange for the attaching section can preferably comprise the area for locating a burner tuber for a forced-air burner.

Preferably the seating section comprises a first support arm and/or a second support arm.

The seating section can preferably comprise a flange to locate a forced-air burner on the device.

The flange for the seating section can preferably be connected to at least one of the support arms.

The flange for the seating section can preferably be an attaching area for a motor to attach a motor of a forced-air burner.

The flange for the seating section can preferably comprise an attaching area for a housing to attach a housing of a forced-air burner.

At least one of the at least one support arms can preferably have an arcuate structure.

At least one of the at least one support arms can preferably be connected to the attaching section.

Preferably the device comprises a support section which is detachably connected to the attaching section and/or to the seating section or can be an integral component of the device.

The support section can preferably comprise a base to locate the device on a manufacturing and/or transportation and/or installation area.

The support section can preferably comprise elements to support a forced-air burner located on the device.

BRIEF DESCRIPTION OF THE DRAWINGS

In the following description of preferred embodiments, reference is made to the appended figures, of which

Comparable components shown in the figures are indicated by the same reference numerals.

DESCRIPTION OF PREFERRED EMBODIMENTS

Figure 1:
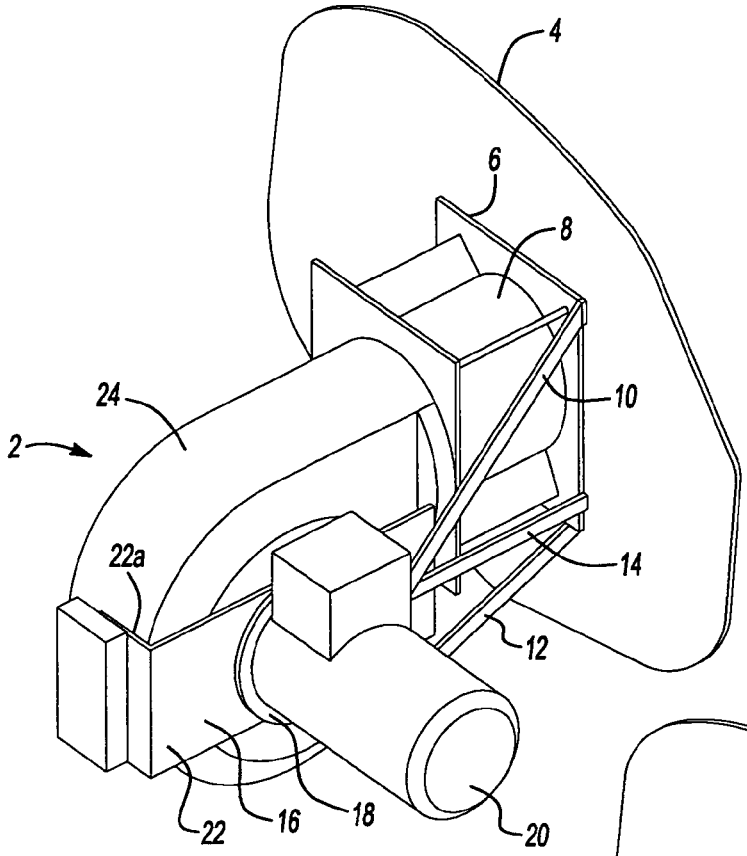
FIG. 1 shows a schematic representation of a preferred embodiment.

FIG. 1 shows an embodiment to locate a forced-air burner 2 for liquid and/or gaseous fuels on a combustion chamber housing 4 (e.g. boiler) which demarcates a combustion chamber not shown. The device comprises an attaching section (not identified) to attach the device immediately to the combustion chamber housing 4. Further, the device comprises a seating device with which forces and/or moments generated by the forced-air burner located on the device can be absorbed which are generated both during operation of the forced-air burner 2 and also when the forced-air burner 2 is not in operation.

The attaching section comprises a flange 6 which is connected for example by bolting, welding and/or riveting to the combustion chamber housing 4. The flange 6 is configured such that a module 8, in particular for introducing fuels, can be located between the forced-air burner 2 and the combustion chamber housing 4. The flange 6 can be configured for this purpose such that it at least partially encompasses the area of the module 8 adjacent the combustion chamber housing 4. By using the device in accordance with the invention it is not necessary that the last named connection has to be designed with respect to forces and/or moments generated by the forced-air burner 2.

In the case of the embodiment from FIG. 1, the seating section comprises a first support arm 10, a second support arm 12 and a third support arm 14 each of which is connected at one end to the flange 6. The other ends of the support arms 10, 12 and 14 are connected to a flange 16 of the seating section. The flange 16 serves to seat the forced-air burner housing 24 to the seating section.

The flange 16 comprises areas to attach the individual components of the forced-air burner 2, as far as necessary, to the device. In particular, the flange 16 comprises a motor attachment area 18 which serves to attach a motor 20 for the forced-air burner 2. The motor attaching area 18 is configured such that the motor 20 is secured to the seating section and the input shaft of the motor 20, not shown, can be passed through the motor attaching area 18.

The flange 16 further comprises a housing attaching area 22 which has an L-shaped area 22*a*. The housing attaching area 22 serves to attach a housing 24 of the forced-air burner 2 to the seating device.

To locate the forced-air burner 2 to the seating section it is envisaged to use detachable and non-detachable connections, for example, bolts, rivets, welds and similar.

Figure 2:
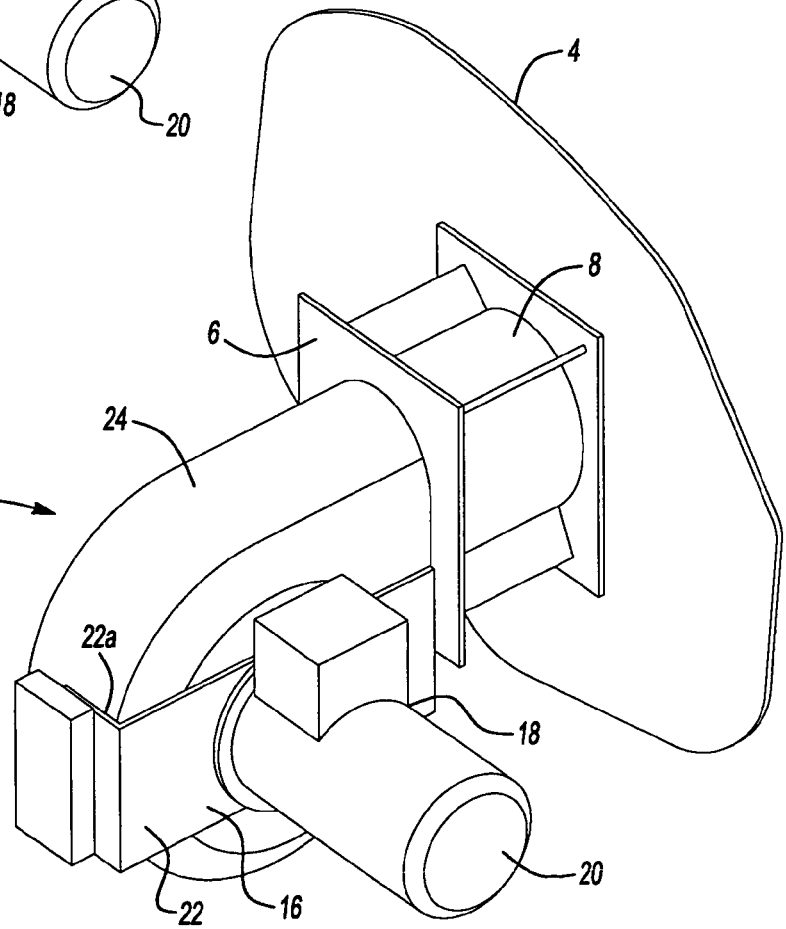
FIG. 2 shows a schematic representation of a further preferred embodiment.

The explanations made with reference to FIG. 1 apply also to the embodiment from FIG. 2 with the exception of the differences mentioned in what follows.

In the case of the embodiment from FIG. 2, the flange 6 is not connected directly to the combustion chamber housing 4. The flange 6 here is instead connected to the end of the module 8 remote from the combustion chamber housing. Consequently, it is necessary that the connection between the module 8 and the combustion chamber housing 4 is configured such that forces and/or moments are absorbed by the forced-air burner 2, the device in accordance with the invention and the module 8 in such a way that there cannot be any damage to the module 8, the combustion chamber housing 4 and the sealing connection between the module 8 and the combustion chamber housing 4. To provide a sealing connection between the module 8 and the combustion chamber housing 4 it may be necessary to provide a connection between the module 8 and the combustion chamber housing 4 which absorbs forces and/or moments, for example through appropriate design and dimensioning of the module 8.

A further difference in the case of the embodiment from FIG. 2, is that the flange 6 is connected to the flange 16 without using support arms. The device and possibly also parts of the housing 24 must be dimensioned appropriately for this purpose.

Figure 3:
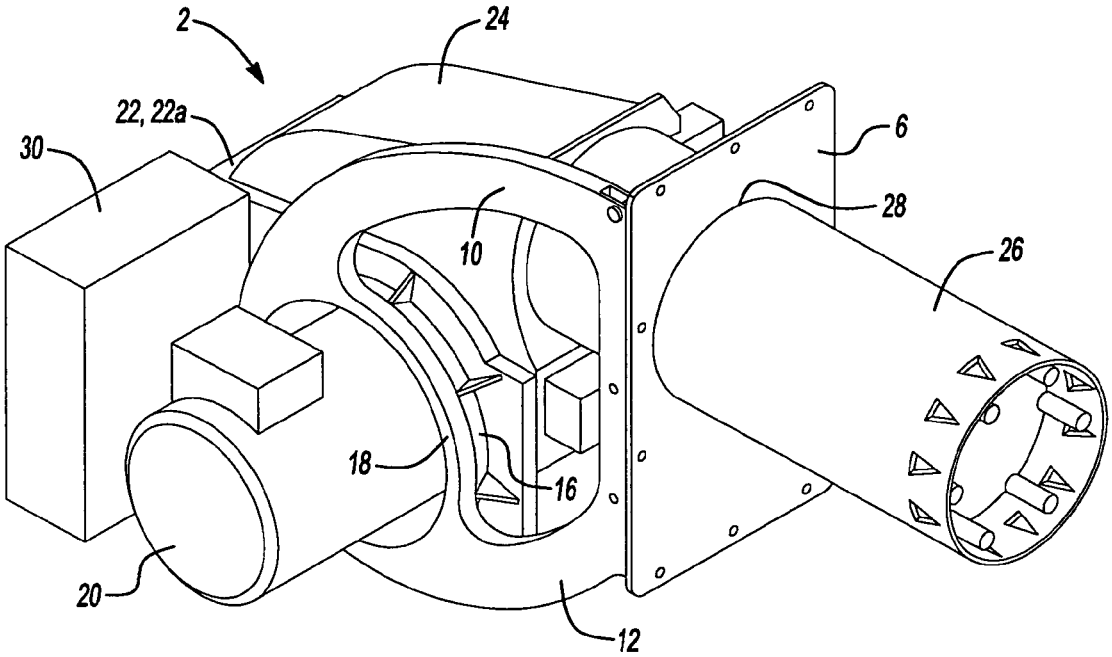
FIGS. 3 to 5 show schematic representations of a further preferred embodiment.
Figure 4:
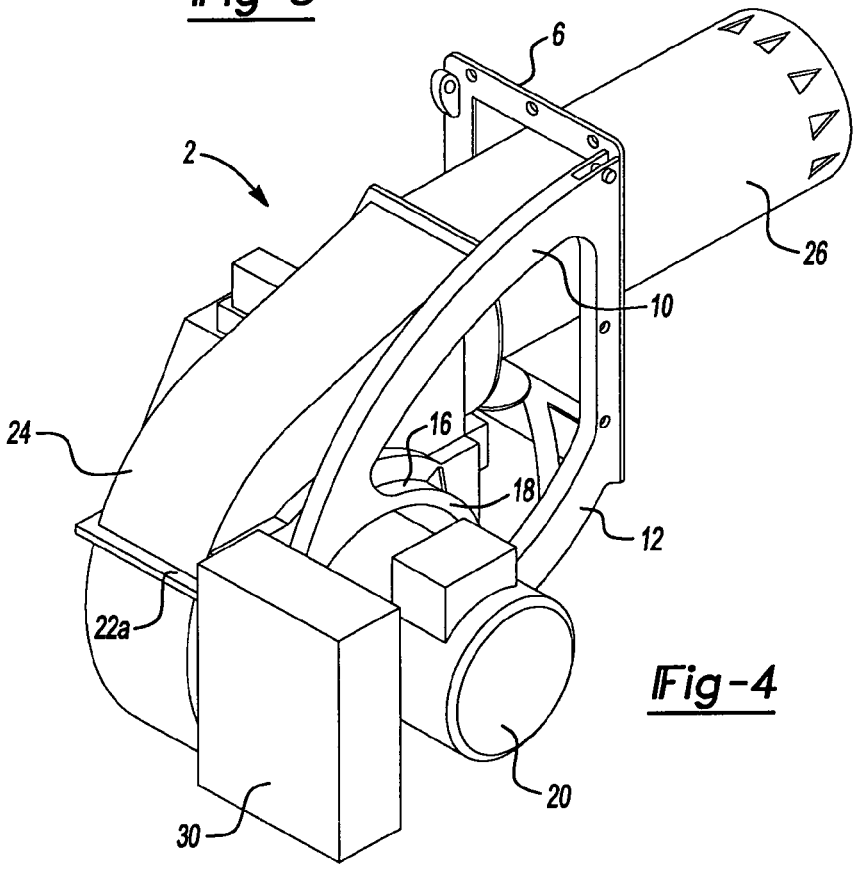
Figure 5:
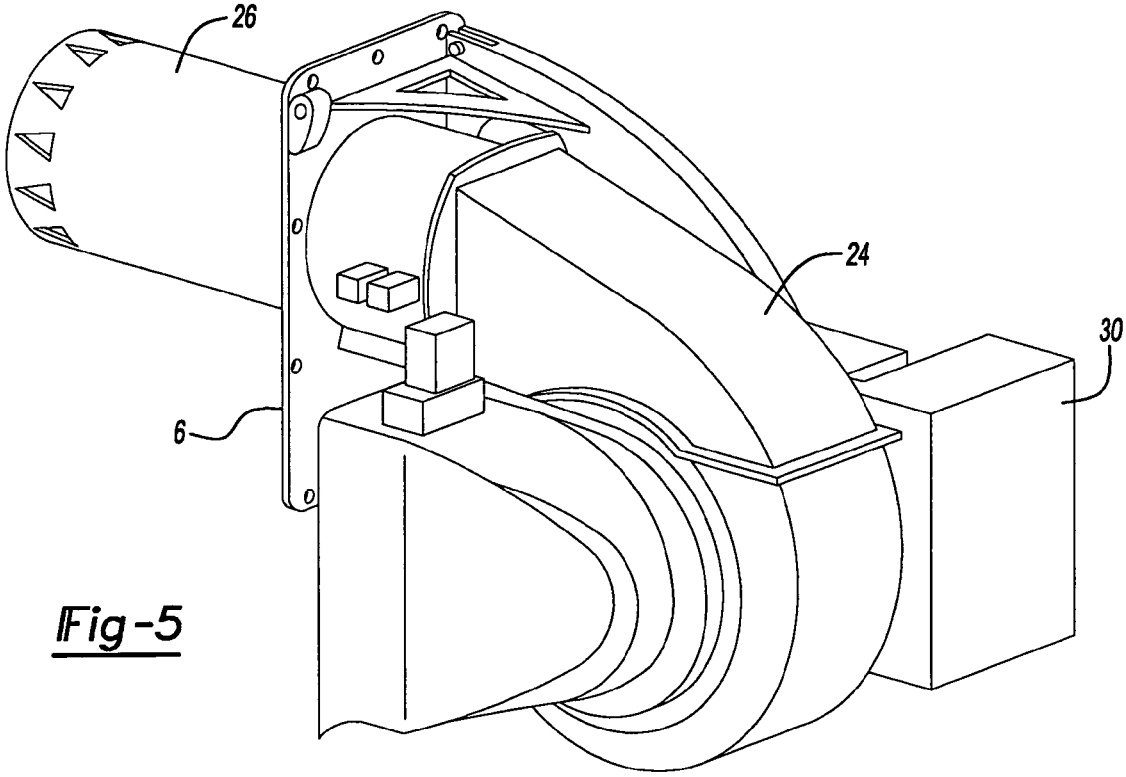

FIGS. 3, 4 and 5 show a further embodiment, in which no comparable component from the module from FIGS. 1 and 2 is used. This embodiment also comprises an attaching section and a seating section for which the explanations give above with reference to FIGS. 1 and 2 similarly apply, except for the following differences.

The flange 6 here is configured as a plane, plate-shaped structure which has holes in the areas along its edges for attaching the flange 6 to a combustion chamber housing (not shown). Furthermore, the flange 6 is designed with an opening 28 through which a burner tube 26 can be passed (in FIGS. 1 and 2 the burner tubes for the forced-air burners are not shown because they are concealed by the module surrounding them). The opening 28 is advantageously dimensioned such that a positive locking connection to the burner tube 26 is possible. In place of the opening 28, the flange 6 can also have a seat, for example, U-shaped into which the burner tube 26 can be introduced.

The seating section of the embodiments from FIGS. 3 to 5 comprises two support arms 10 and 12 which extend away from the flange 6 in an arcuate shape to the motor attaching area 18. The motor attaching area 18 here comprises a circular or annular structure (not shown) which encircles the motor 10 and advantageously serves to attach it. The housing attaching area 22 here comprises an L-shaped area 22*a* which can be used to locate additional components for the forced-air burner 2, such as for example, an electronics module 30.

Figure 6:
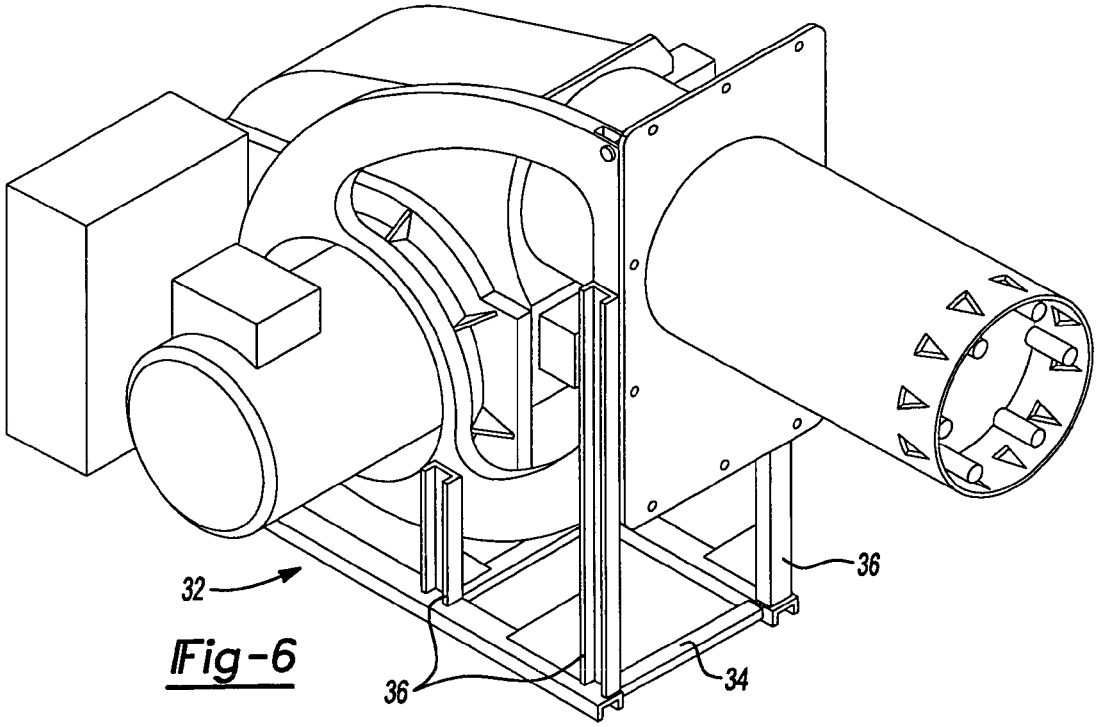
FIG. 6 shows a schematic representation of a further preferred embodiment and, FIGS. 7 to 10 schematic representations of a further preferred embodiment.
Figure 7:
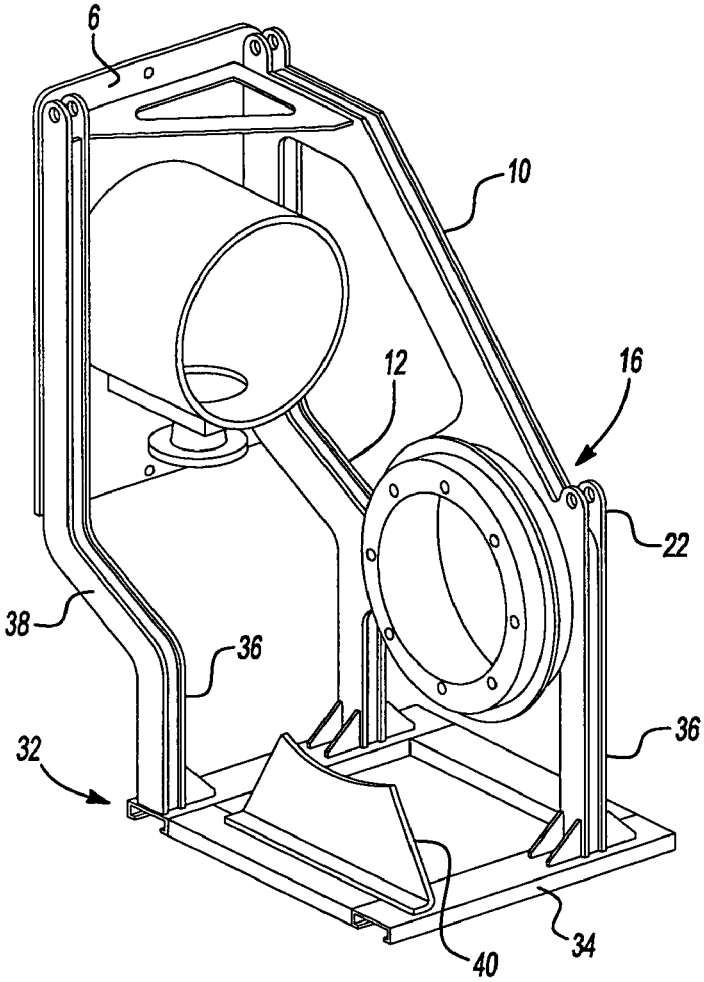
Figure 8:
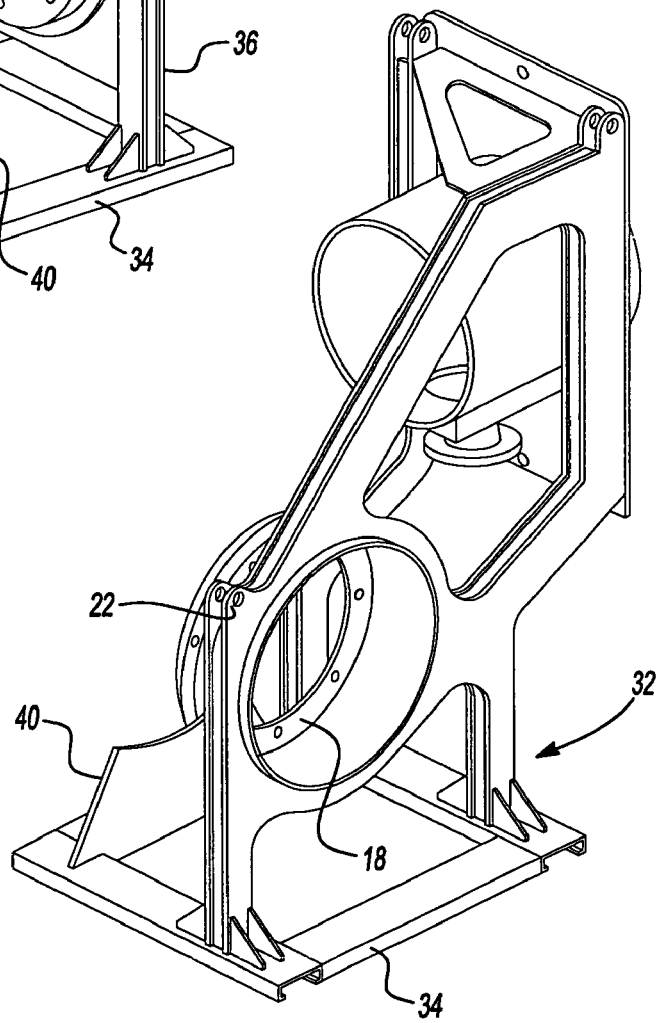
Figure 9:
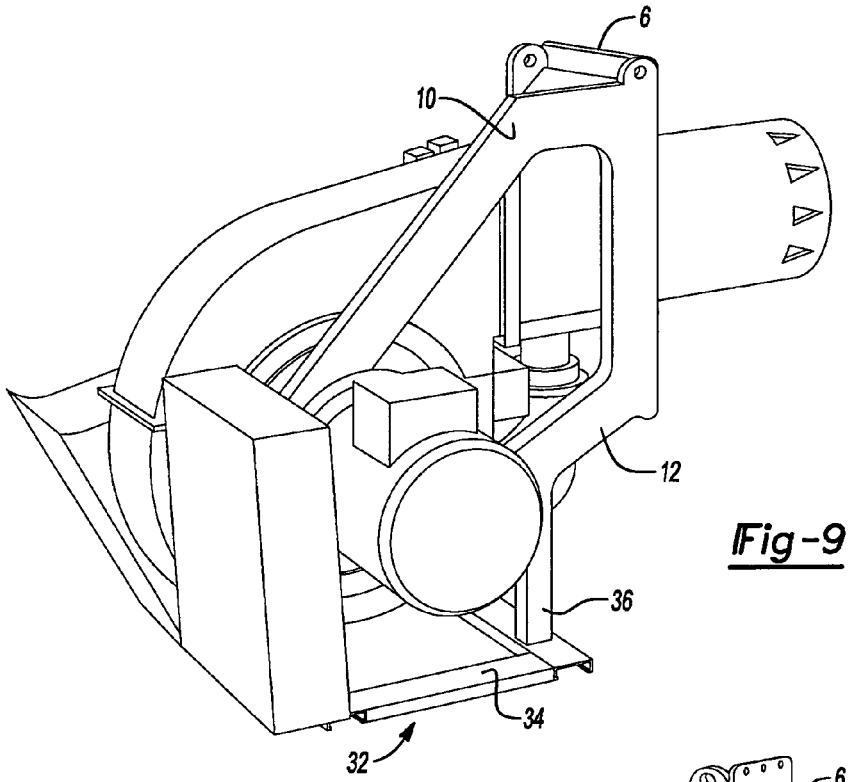
Figure 10:
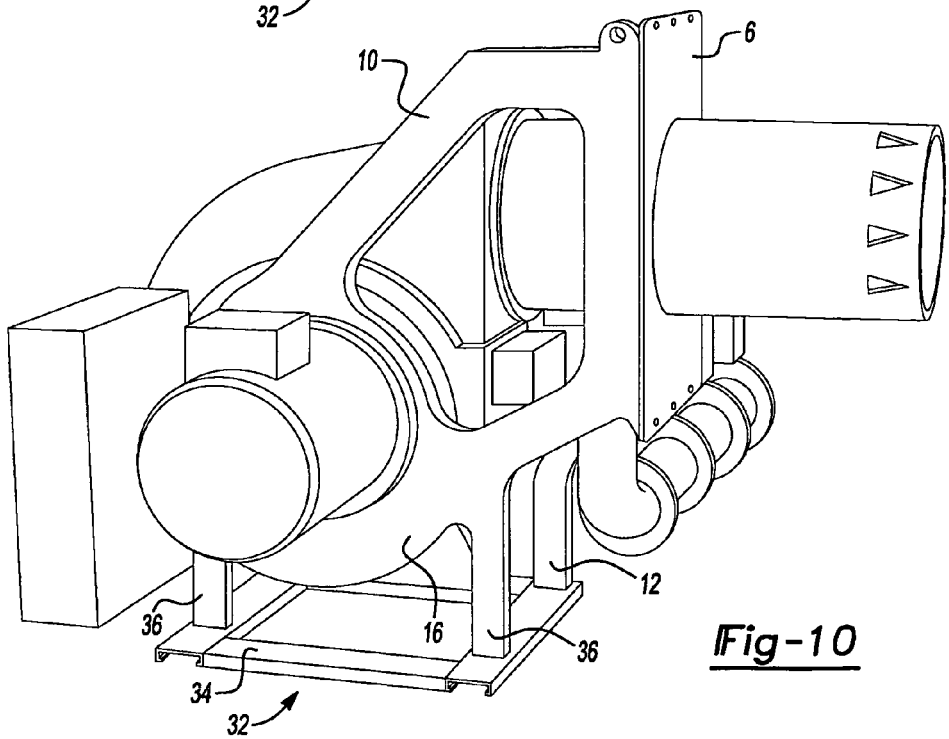

The embodiment shown in FIG. 6 represents a modification of the embodiment from FIGS. 3 to 5. In addition to the components shown in FIGS. 3 to 5, the embodiment from FIG. 6 comprises a support area 32. In this embodiment, the support area 32 is detachably connected to the attaching and seating devices and can be used in the (pre) assembly of the device and the forced-air burner, its transportation and installation to the combustion chamber housing, for example, when using pallets and/or fork lifts.

The support area 32 makes it possible to prepare the forced-air burner 2 pre-assembled with the attaching and seating devices located thereon.

The support area 32 comprises a base 34 with which the entire array shown in FIG. 6 can be arranged during (pre) assembly and/or during installation to the combustion chamber housing on an assembly area (e.g. floor, fork lift truck). The support area 32 further comprises elements 36 to brace the attaching and seating devices and advantageously also the forced-air burner 2. Following installation to the combustion chamber housing, the support area 32 can be removed.

Advantageously the support area 32 can be used during transportation.

FIGS. 7 to 10 show a further embodiment. This embodiment also comprises an attaching section and a seating device for which the explanations given above with reference to FIGS. 1 to 6 similarly apply, except for the following differences.

In this embodiment, the support area 32 is an integral component of the device. In addition to the support arms 10 and 12 extending from one side of the flange 6, an additional support arm 38 goes from the opposite side of the flange 6 which merges into one of the elements 36.

From the base 34 of the support area 32, a brace 40, which may have a plane configuration for example, extends essentially perpendicularly upward. The brace 40 serves to brace one part of the housing of a forced-air burner and to absorb forces and/or moments during assembly, transportation and operation.

Normally the device with a forced-air burner located on it is attached to a combustion chamber such that the support area 32 does not contact the ground. It is also conceivable to attach the device with a forced-air burner located on it to a combustion chamber such that the support area 32 does contact the ground.

It is common to all embodiments that, in contrast to the prior art, it is no longer necessary to design the housing of the forced-air burner as a whole specifically with respect to mechanical durability to absorb forces and/or moments from the forced-air burner. Instead, it is sufficient to consider the housing of the forced-air burner alone. This likewise applies when using a unit comparable to the module shown in FIGS. 1 and 2.

The use of the present invention makes it possible to implement a light-weight construction concept with respect to forced-air burners and in particular to their housings. The weight savings possible thereby with forced-air burners are greater than the expenses which are necessary when the present invention is implemented.

Overall manufacturing expense is reduced by the present invention. An implementation of the present invention, in particular a computation and design of a inventive device with regard to its durability, is clearly simpler than what is required in the layout and design of conventional forced-air burners. The overall costs incurred are reduced by the present invention.

Furthermore, the present invention makes it possible to consider a light-weight design concept regarding forced-air burners such that, for example, partial opening of the housing of the forced-air burner is possible in the assembled state, for example during assembly, start of operation, normal operation and maintenance. For example, a design for the housing which makes opening the upper part of the housing possible can represent a significant improvement during start of operation and maintenance. During start of operation and maintenance it is often necessary to access the mixing device. In order to do this previously, it was necessary to swing the entire forced-air burner laterally from the combustion chamber housing. The present invention avoids this because it is now possible to provide housings of forced-air burners with suitable openings whereby no special regard has to be paid to the previous requirement of having to take the mechanical strength of the entire system into consideration.

What is claimed is:

1. A mounting device for mounting a forced-air burner to a combustion chamber housing, the forced-air burner including a burner housing and a motor, comprising:

a burner housing attachment area operable to attach to the burner housing of the forced-air burner;

an attaching section comprising an attaching section flange operable to attach to the combustion chamber housing; and a seating section operable to absorb loads caused by the forced-air burner located on the device, wherein the seating section comprises a seating section flange that is connected to the burner housing attachment area, the seating section flange having a motor attaching area, the motor attaching area having an annular structure operable to attach to the motor of the forced-air burner, and wherein the seating section further comprises at least one support element that is attached to the motor attaching area and to the attaching section flange.

2. The device according to claim 1, wherein the attaching section flange provides at least one of a positive locking and an interference-fit connection to the combustion chamber housing or to a unit located on a combustion chamber housing.

3. The device according to claim 1, wherein the at least one support element includes a first support arm and a second support arm, wherein each of the first and second support arms are attached to the motor attaching area and the attaching section flange.

4. The device according to claim 1, wherein the seating section flange is operable to attach to the burner housing.

5. The device according to claim 1, wherein the at least one support element includes an arm extending arcuately from the motor attaching area to the attaching section flange.

6. The device according to claim 1, further comprising a support section which is one of detachably connected to the attaching section and integrally connected to the attaching section, the support section operable to independently support the device.

7. The device according to claim 1, further comprising:

a motor attached to the motor attaching area, wherein the motor and the forced air burner are located on opposite sides of the seating section flange of the seating section.

8. A mounting device for mounting a forced-air burner to a combustion chamber housing comprising:

sections for attaching the forced-air burner to the mounting device;

an attaching section comprising a flange to attach the device to a combustion chamber housing demarcating a combustion;

a seating section to absorb forces and/or moments caused by a forced-air burner located on the device, wherein the seating section comprises a flange to accommodate the forced-air burner on the device, wherein the flange of the seating section comprises a motor attaching area having an annular structure to attach a motor of the forced-air burner and wherein the seating section further comprises at least one support arm extending away from the motor attaching area to the flange of the attaching section and connecting the motor attaching area with the flange of the attaching section, wherein the at least one support arm is arcuate shaped and extends away from the flange of the attaching section toward the flange of the motor attaching area; and a motor attached to the motor attaching area, wherein the motor and the forced air burner are located on opposite sides of the seating section flange of the seating section.

9. The device according to claim 1, wherein the burner housing attachment area extends at a positive angle from the seating section flange.

10. The device according to claim 9, wherein the angle is approximately ninety degrees.

11. The device according to claim 1, wherein the motor attaching area has a continuous ring-shape to continuously encircle the motor.

* * * * *